US011607598B2

(12) United States Patent
Luo

(10) Patent No.: US 11,607,598 B2
(45) Date of Patent: Mar. 21, 2023

(54) FOLDING TREADMILL AND FOLDING METHOD

(71) Applicant: Jiangxi EQI Industrial Co., Ltd, Jiangxi (CN)

(72) Inventor: Xietong Luo, Jiangxi (CN)

(73) Assignee: Jiangxi EQI Industrial Co., Ltd, Jiangxi (CN)

( * ) Notice: Subject to any disclaimer, the term of this patent is extended or adjusted under 35 U.S.C. 154(b) by 65 days.

(21) Appl. No.: 17/202,376

(22) Filed: Mar. 16, 2021

(65) Prior Publication Data

US 2021/0402279 A1 Dec. 30, 2021

(30) Foreign Application Priority Data

Jun. 24, 2020 (CN) ..... 202010588231.4

(51) Int. Cl.
*A63B 71/00* (2006.01)
*A63B 22/02* (2006.01)

(52) U.S. Cl.
CPC ..... *A63B 71/0036* (2013.01); *A63B 22/02* (2013.01); *A63B 2210/50* (2013.01)

(58) Field of Classification Search
CPC ..... A63B 71/0036; A63B 2210/50; A63B 22/02–0292; A63B 69/0028
See application file for complete search history.

(56) References Cited

U.S. PATENT DOCUMENTS 7,942,788 B2 * 5/2011 Wu ..... A63B 22/0235 482/54
2005/0192162 A1 * 9/2005 Pan ..... A63B 22/02 482/54
2007/0066448 A1 * 3/2007 Pan ..... A63B 22/0235 482/54

(Continued)

FOREIGN PATENT DOCUMENTS

CN 210278104 4/2020
CN 111150967 A * 5/2020

(Continued)

OTHER PUBLICATIONS

"Office Action of China Counterpart Application", dated Mar. 2, 2021, p. 1-p. 6.

(Continued)

*Primary Examiner* — Nyca T Nguyen
(74) *Attorney, Agent, or Firm* — JCIP Global Inc.

(57) ABSTRACT

Disclosed are a folding treadmill and a folding method. A folding method of a folding treadmill includes the following steps: unlocking a pin lock assembly to enable a column assembly and a running platform to be in an unlocked free state, then unfolding or folding the column assembly to be in an unfolded state or a folded state relative to the running platform, and locking the pin lock assembly to complete the unfolding or folding of the treadmill. By means of the pin lock assembly, the column assembly can be firmly locked on the running platform no matter whether the column assembly is in the unfolded state or the folded state, thus not only (Continued)

achieving rapid unfolding and folding, but also ensuring the stability of the unfolded state or the folded state, and improving the safety of the folded state.

11 Claims, 6 Drawing Sheets

(56) References Cited

U.S. PATENT DOCUMENTS

2009/0042698 A1* 2/2009 Wang ..... A63B 22/02 482/54
2009/0280964 A1* 11/2009 Chen ..... A63B 22/02 482/54
2013/0237383 A1* 9/2013 Chen ..... A63B 22/02 482/54
2015/0051051 A1* 2/2015 Liu ..... A63B 22/02 482/54
2015/0209610 A1* 7/2015 Dalebout ..... A63B 71/0622 482/54
2021/0387043 A1* 12/2021 Tian ..... A63B 22/0235
2022/0126165 A1* 4/2022 Tsai ..... A63B 22/02

FOREIGN PATENT DOCUMENTS

CN 212416814 U * 1/2021
CN 112741994 A * 5/2021 ..... A63B 22/02
CN 113426065 A * 9/2021 ..... A63B 22/0235
CN 113996007 A * 2/2022 ..... A63B 22/02
CN 215900838 U * 2/2022

OTHER PUBLICATIONS

"Office Action of China Counterpart Application", dated Nov. 25, 2021, p. 1 -p. 6.
"Office Action of China Counterpart Application", dated Jun. 6, 2022, p. 1-p. 7.

* cited by examiner

FOLDING TREADMILL AND FOLDING METHOD

CROSS-REFERENCE TO RELATED APPLICATION

This application claims the priority benefit of China application serial no. 202010588231.4, filed on Jun. 24, 2020. The entirety of the above-mentioned patent application is hereby incorporated by reference herein and made a part of this specification.

BACKGROUND

Technical Field

The present disclosure relates to the technical field of treadmills, and in particular to a folding treadmill and a folding method.

Description of Related Art

Existing treadmills are generally foldable, which not only facilitates packaging and transportation, but also saves limited living space for a user. In a column folding mechanism of some existing treadmills, a column is folded by manually operating a button or releasing a fastener. With regard to using a manual folding method, due to a relatively large size of the treadmill, it is necessary to bend over to control folding buttons on two sides of a front end of the treadmill. The folding operation is very inconvenient, and there are many movements, so that the customer experience is poor. A locked state of an existing folding treadmill is mainly for an unfolded column, and the folded column is in a free state. Not only is there a problem of wear caused by rotation during transportation, but also there is a safety hazard after the treadmill is folded by a user.

SUMMARY

On this basis, with regard to the above technical problem, the present disclosure provides a folding treadmill and a folding method. The folding treadmill in the present disclosure is in a folded state during transportation, which is beneficial to minimizing the packing size; and when the folding treadmill needs to be unfolded or folded, a user can easily and conveniently complete unfolding or folding by operating a pin lock assembly. By means of the pin lock assembly according to the present disclosure, a column assembly can be firmly locked on a running platform no matter whether the column assembly is in an unfolded state or a folded state, thus not only achieving rapid unfolding and folding, but also ensuring the stability of the unfolded state or the folded state, and improving the safety of the folded state.

In order to solve the above technical problem, the present disclosure adopts the following technical solution:

A folding method of a folding treadmill includes the following steps: unlocking a pin lock assembly to enable a column assembly and a running platform to be in an unlocked free state, then unfolding or folding the column assembly to be in an unfolded state or a folded state relative to the running platform, and locking the pin lock assembly to complete the unfolding or folding of the treadmill.

As a preferred embodiment of the folding method of a folding treadmill provided in the present disclosure, the pin lock assembly includes a switch handle, a connecting rod, at least two springs, at least two pin members and at least two pin hole members, wherein the switch handle is eccentrically rotatably connected to one end of the connecting rod and is arranged on one side of the running platform; the springs, the pin members and the pin hole members sleeve the connecting rod; a locking member is arranged on the other end of the connecting rod and is arranged on the other side of the running platform; one of the pin members, one of the springs and one of the pin hole members are arranged opposite to each other to form a pin lock set, and two pin lock sets are respectively arranged between two vertical pipes of the column assembly and the running platform; and the end parts of the springs abut against the pin members and/or the pin hole members.

As a preferred embodiment of the folding method of a folding treadmill provided in the present disclosure, a push block is arranged at the end, connected to the connecting rod, of the switch handle.

As a preferred embodiment of the folding method of a folding treadmill provided in the present disclosure, the pin members are arranged on the vertical pipes, and the pin hole members are correspondingly arranged on the running platform.

As a preferred embodiment of the folding method of a folding treadmill provided in the present disclosure, the pin members are arranged on the running platform, and the pin hole members are correspondingly arranged on the vertical pipes.

As a preferred embodiment of the folding method of a folding treadmill provided in the present disclosure, each pin member includes a pin plate and one pin set, the one pin set is arranged on one side of the pin plate, and the pin set includes at least one pin; each pin hole member includes a pin hole plate and two pin hole sets formed in the pin hole plate, each of the pin hole sets includes at least one pin hole; the two pin hole sets include an unfolding pin hole set for unfolding and a folding pin hole set for folding, and the at least one pin hole of each of the pin hole sets is arranged corresponding to the at least one pin.

As a preferred embodiment of the folding method of a folding treadmill provided in the present disclosure, the at least one pin includes at least three pins, and the at least one pin hole includes at least three pin holes.

As a preferred embodiment of the folding method of a folding treadmill provided in the present disclosure, the pin lock assembly further includes limiting members, wherein each limiting member includes a limiting pin and a limiting slot which are matched, and the limiting slot is set as an arc-shaped structure to adapt to a rotation path of the column assembly.

As a preferred embodiment of the folding method of a folding treadmill provided in the present disclosure, the pin lock assembly further includes a thrust member, which sleeves the connecting rod and located between the switch handle and the pin member.

A folding treadmill is provided to implement the folding method of a folding treadmill.

Compared with the prior art, the present disclosure has the following beneficial effects:

According to the folding method of a treadmill in the present disclosure, by means of the pin lock assembly, the column assembly can be firmly locked on the running platform no matter whether the column assembly is in an unfolded state or a folded state, thus not only achieving rapid unfolding and folding, but also ensuring the stability of the unfolded state or the folded state, and improving the safety of the folded state. The folding treadmill in the present disclosure is in a folded state during transportation, which is beneficial to minimizing the packing size, and when the folding treadmill needs to be unfolded or folded, a user can easily and conveniently complete unfolding or folding by operating the pin lock assembly.

BRIEF DESCRIPTION OF THE DRAWINGS

In order to more clearly explain the solution in the present application or the prior art, a brief introduction will be made hereinafter to the drawings needed in the description of the embodiments or the prior art. Obviously, the drawings in the following description are some embodiments of the present application. For those of ordinary skill in the art, other drawings can be obtained from these drawings without involving inventive efforts.

In drawings, 100—running platform, 110—ferrule, 120—connector, 200—column assembly, 210—vertical pipe, 220—horizontal pipe, 230—vertical pipe housing, 300—pin lock assembly, 310—switch handle, 311—push block, 320—connecting rod, 330—spring, 340—pin member, 341—pin plate, 342—pin set, 343—pin, 350—pin hole member, 351—pin hole plate, 352—unfolding pin hole set, 353—folding pin hole set, 354—pin hole, 360—locking member, 370—limiting member, 371—limiting pin, 372—limiting slot, 380—thrust member.

DETAILED DESCRIPTION OF THE EMBODIMENTS

The terms or words used in the present description and claims should not be construed as a general meaning or a dictionary meaning, but should be construed as a meaning and concept conforming to the technical idea of the present disclosure according to the principle that "the concept of the wording can be properly defined in order to explain the inventor's disclosure in the best way".

Throughout the description, when a part "includes" a certain component, it means that the component may further include other components, without excluding other components, unless otherwise specified. In addition, the terms such as "... part", "... set", "module" and "apparatus" described in the description refer to a unit that processes at least one function or operation, and may be implemented by hardware or software, or a combination of hardware and software.

Hereinafter, the embodiments of the present disclosure will be described in detail with reference to the drawings.

Embodiment 1

Figure 1:
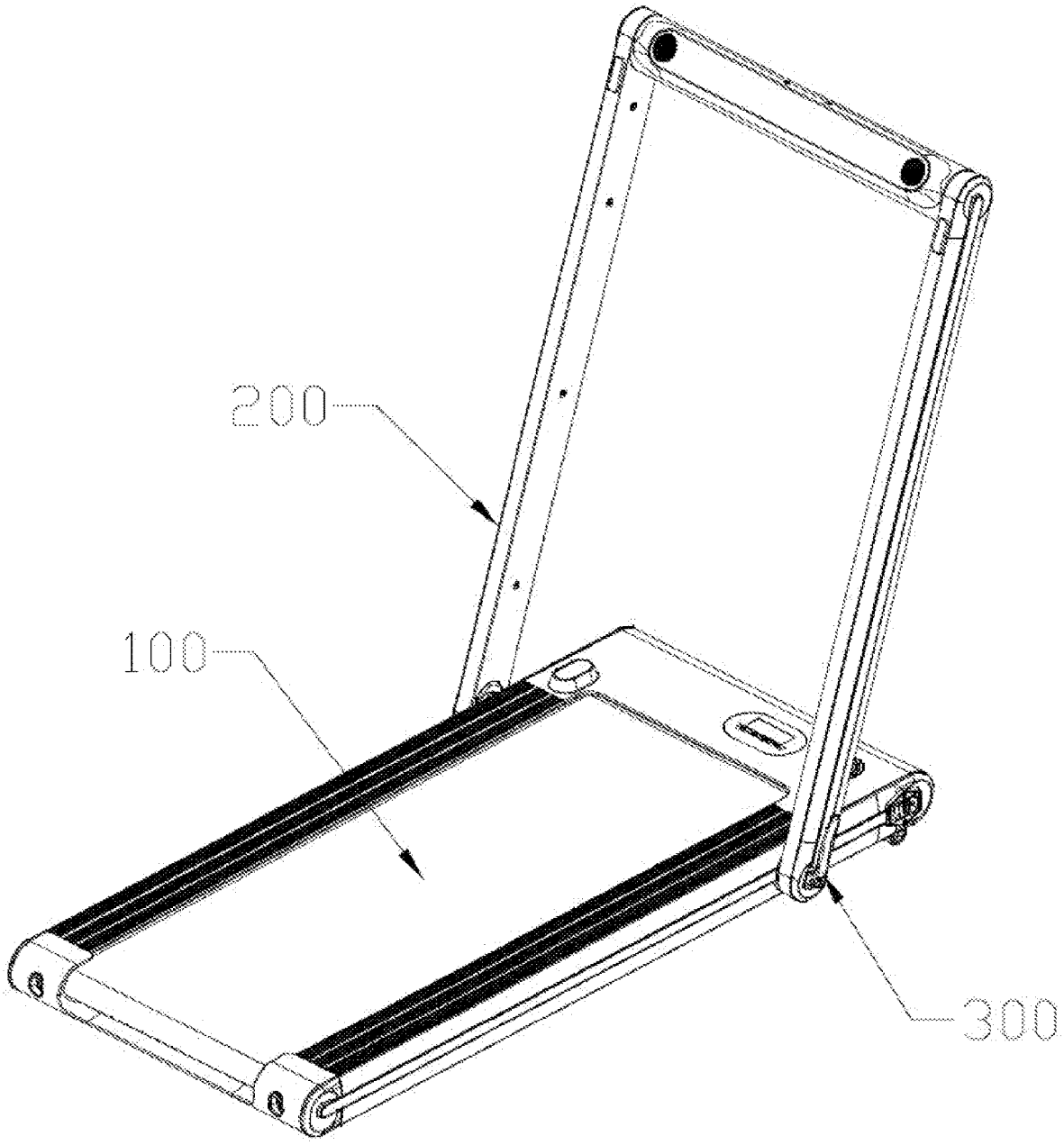
FIG. 1 is a structural schematic view of a folding treadmill in an unfolded state according to the present disclosure.
Figure 2:
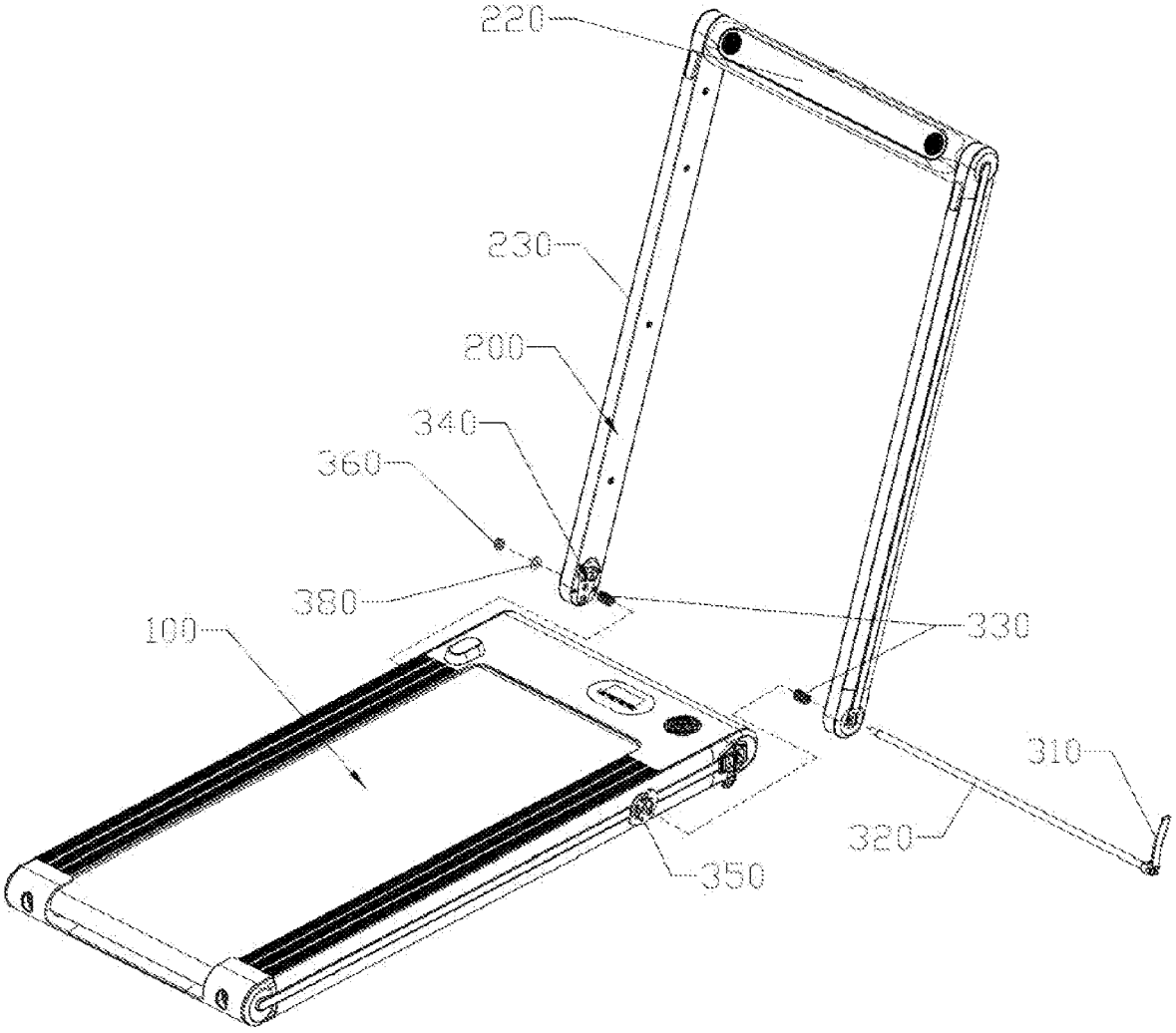
FIG. 2 is a partially exploded schematic view of the folding treadmill in the unfolded state according to the present disclosure.
Figure 3:
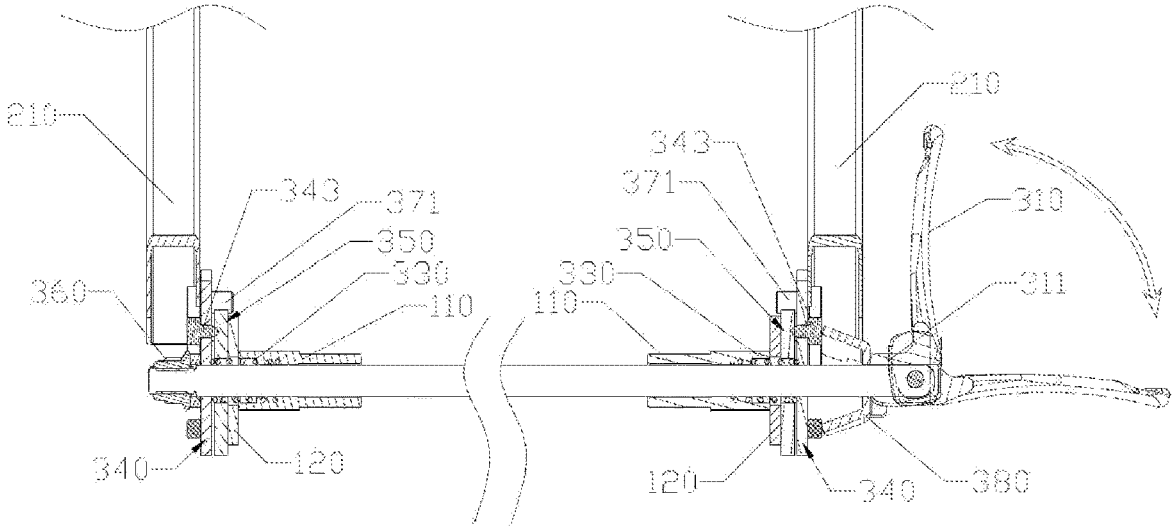
FIG. 3 is a cross-sectional view of a pin lock assembly of the folding treadmill in the unfolded state according to the present disclosure, wherein a switch handle in dotted lines is in a loosened state, a switch handle in solid lines is in a tightened state, and the arrow is a switching process of loosening and tightening the switch handle.
Figure 4:
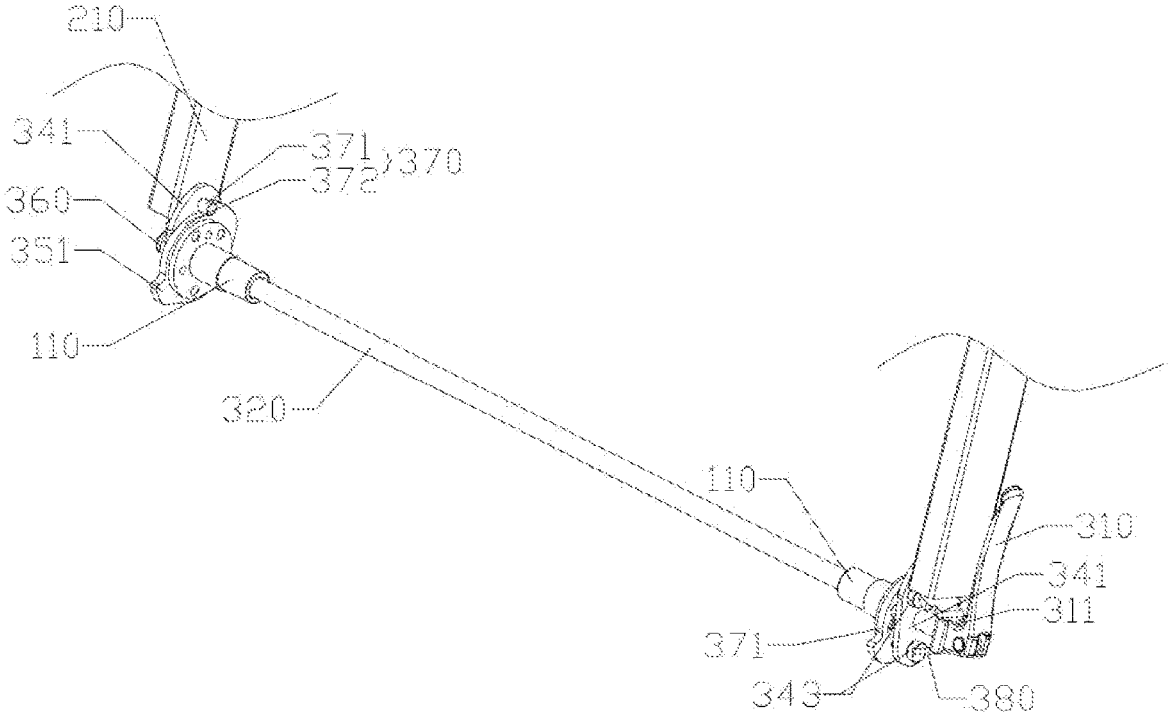
FIG. 4 is a structural schematic view of the pin lock assembly of the folding treadmill in the unfolded state according to the present disclosure.
Figure 5:
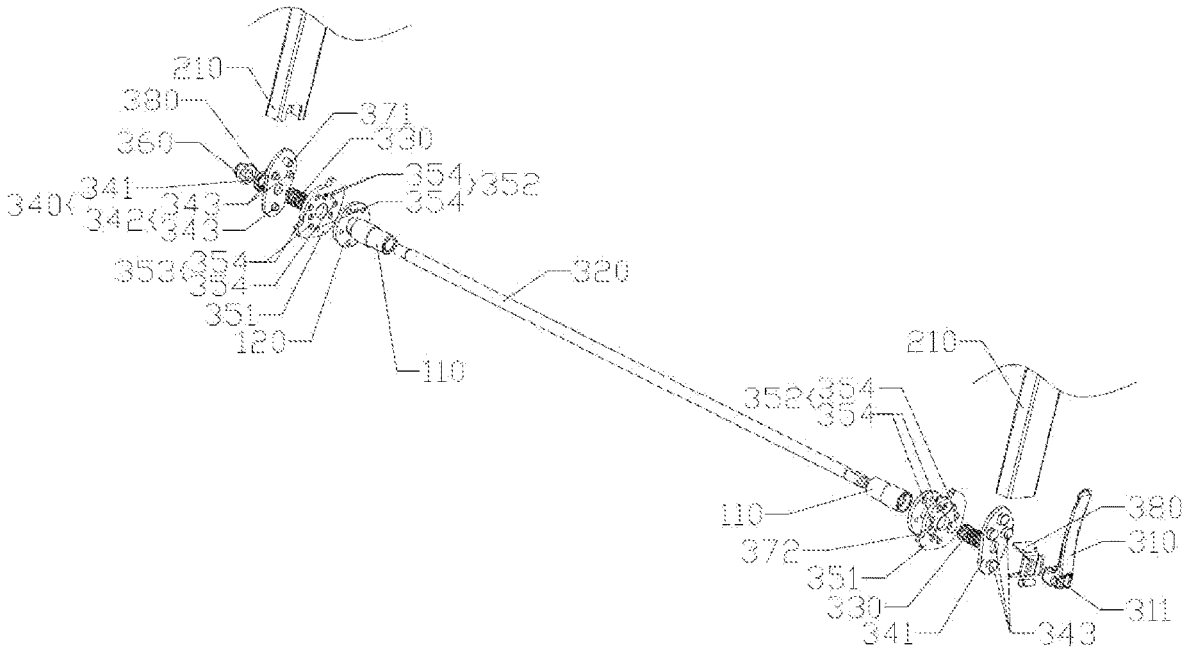
FIG. 5 is an exploded schematic view of the pin lock assembly of the folding treadmill in the unfolded state according to the present disclosure.
Figure 6:
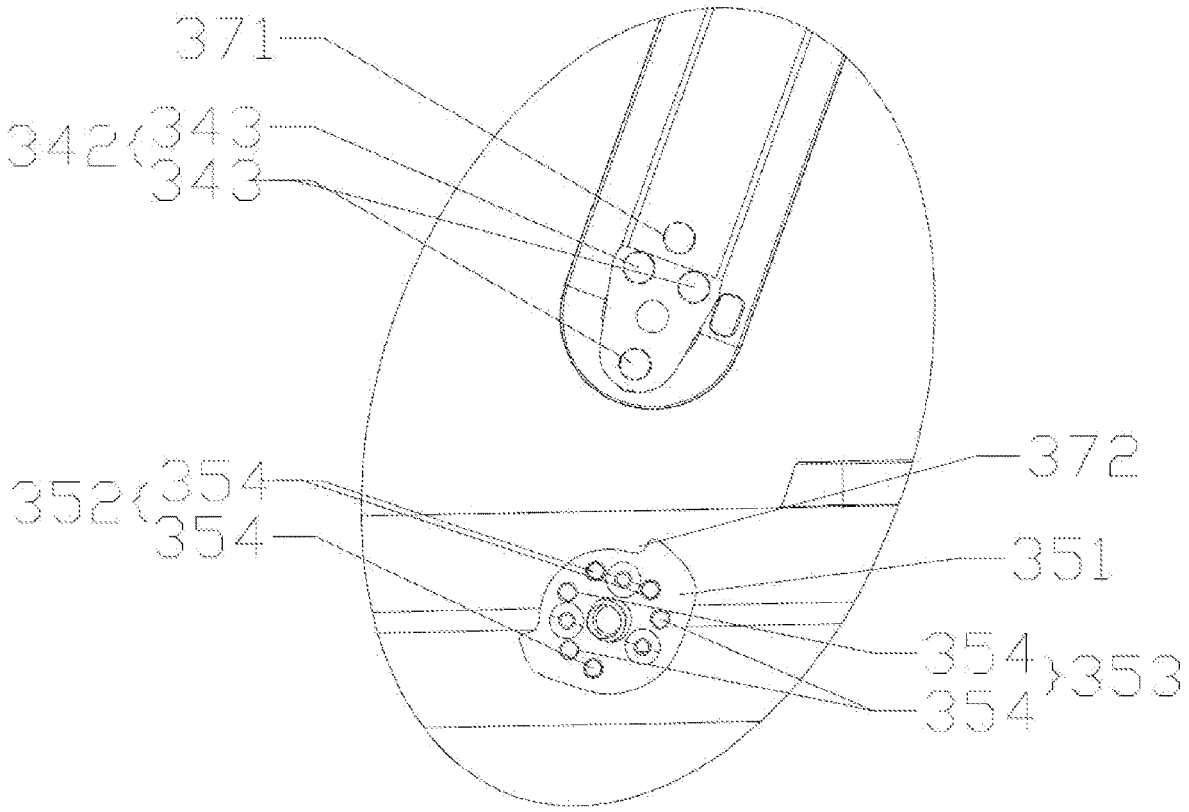
FIG. 6 is a partially exploded schematic view of the folding treadmill in the unfolded state according to the present disclosure.
Figure 7:
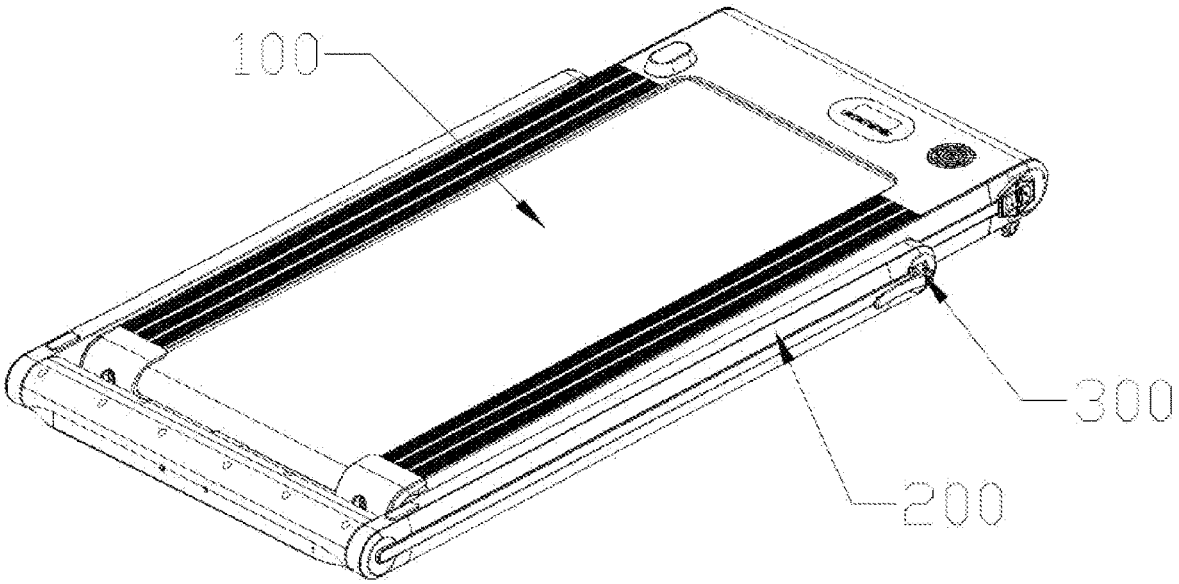
FIG. 7 is a structural schematic view of a folding treadmill in a folded state according to the present disclosure.
Figure 8:
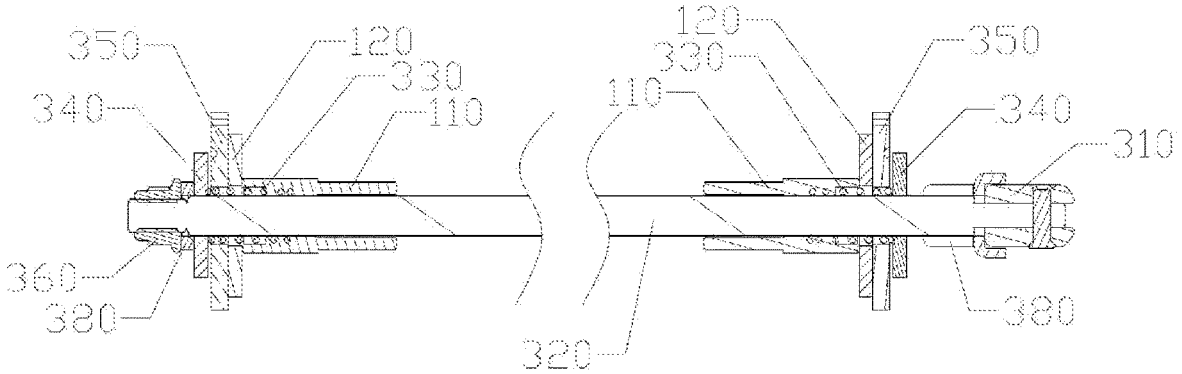
FIG. 8 is a cross-sectional view of the pin lock assembly of the folding treadmill in the folded state according to the present disclosure.
Figure 9:
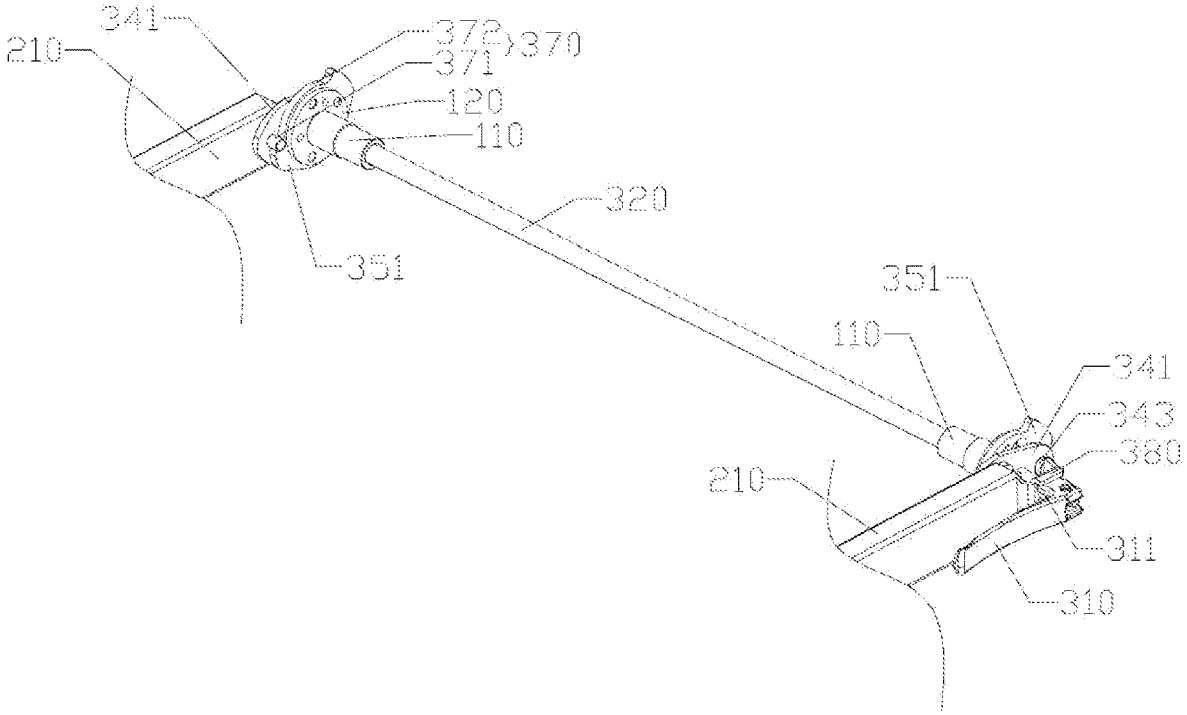
FIG. 9 is a schematic structural view of the pin lock assembly of the folding treadmill in the folded state according to the present disclosure.
Figure 10:
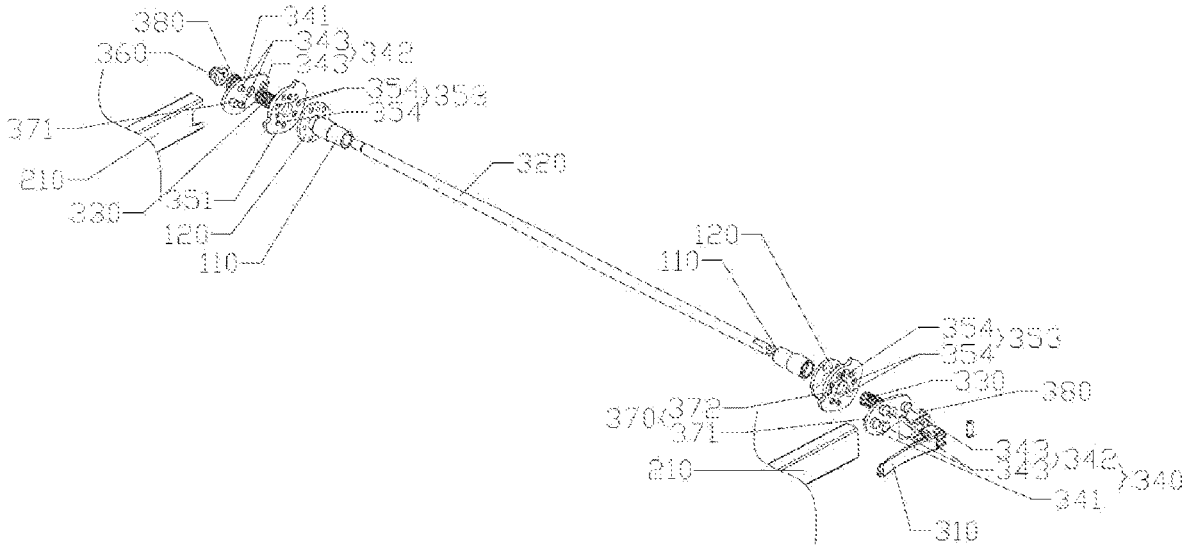
FIG. 10 is an exploded schematic view of the pin lock assembly of the folding treadmill in the folded state according to the present disclosure.

A folding method of a folding treadmill is provided in the present embodiment, including the following steps: unlocking a pin lock assembly 300 to enable a column assembly 200 and a running platform 100 to be in an unlocked free state, then unfolding or folding the column assembly 200 to be in an unfolded state (as shown in FIG. 1) or a folded state (as shown in FIG. 7) relative to the running platform 100, and locking the pin lock assembly 300 to complete the unfolding or folding of the treadmill.

As shown in FIGS. 3-6 and 8-10, the pin lock assembly 300 includes a switch handle 310, a connecting rod 320, at least two springs 330, at least two pin members 340 and at least two pin hole members 350. The switch handle 310 is eccentrically rotatably connected to one end of the connecting rod 320 and is arranged on one side of the running platform 100; the springs 330, the pin members 340 and the pin hole members 350 sleeve the connecting rod 320; and a locking member 360 is arranged on the other end of the connecting rod 320 and is arranged on the other side of the running platform 100 for limiting to avoid disengagement. One of the pin members 340, one of the springs 330 and one of the pin hole members 350 are arranged opposite to each other to form a pin lock set, and two pin lock sets are respectively arranged between two vertical pipes 210 of the column assembly 200 and the running platform 100; and the end parts of the springs 330 abut against the pin members 340 and/or the pin hole members 350. The pin members 340 are optionally arranged on the vertical pipes 210 or on the running platform 100. Correspondingly, the pin hole members 350 are optionally arranged on the running platform 100 or on the vertical pipes 210. When the switch handle 310 is rotated to be perpendicular to the connecting rod 320, that is, the switch handle 310 is tightened, at this moment, the switch handle 310 locks the connecting rod 320, the springs 330 are stressed to be in a compressed state, pins 343 on the pin members 340 of the two pin lock sets are engaged with pin holes 354 in the pin hole members 350 to realize a locked fixing state between the vertical pipes 210 and the running platform 100; when the switch handle 310 is rotated to be parallel to the connecting rod 320, that is, the switch handle 310 is loosened, at this moment, the switch handle 310 releases the connecting rod 320, the springs 330 are not stressed to release the compressed elastic force so that the pins 343 on the pin members 340 of the two pin lock sets are disengaged from the pin holes 354 in the pin hole members 350 to realize an unlocked free state between the vertical pipes 210 and the running platform 100.

Embodiment 2

As shown in FIGS. 1-10, a folding treadmill is provided in the present embodiment, including:

a running platform 100, for running or walking;

a column assembly 200, rotatably connected to the running platform 100 to be rotated to a folded state or an unfolded state relative to the running platform 100; and a pin lock assembly 300, for controlling the column assembly 200 in the folded state and the unfolded state and the running platform 100 to be a locked fixing state or an unlocked free state.

The column assembly 200 is a U-shaped column, and includes two vertical pipes 210 and one horizontal pipe 220; two ends of the horizontal pipe 220 are respectively connected to the two vertical pipes 210 to form a U-shaped structure. The vertical pipes 210 are rotatably connected to sides of the running platform 100. When the column assembly 200 is in the folded state, the vertical pipes 210 are rotated and laid flat relative to the running platform 100 toward the tail of the running platform 100, the horizontal pipe 220 is located at the side of the tail of the running platform 100, and a height of the folded treadmill is only a height of the running platform 100 itself.

As shown in FIGS. 3-6 and 8-10, the pin lock assembly 300 includes a switch handle 310, a connecting rod 320, at least two springs 330, at least two pin members 340 and at least two pin hole members 350. The switch handle 310 is eccentrically rotatably connected to one end of the connecting rod 320 and is arranged on one side of the running platform 100; the springs 330, the pin members 340 and the pin hole members 350 sleeve the connecting rod 320; and a locking member 360 is arranged on the other end of the connecting rod 320 and is arranged on the other side of the running platform 100 for limiting to avoid disengagement. One of the pin members 340, one of the springs 330 and one of the pin hole members 350 are arranged opposite to each other to form a pin lock set, and two pin lock sets are respectively arranged between the two vertical pipes 210 and the running platform 100; and the end parts of the springs 330 abut against the pin members 340 and/or the pin hole members 350. The pin members 340 are optionally arranged on the vertical pipes 210 or on the running platform 100. Correspondingly, the pin hole members 350 are optionally arranged on the running platform 100 or on the vertical pipes 210. When the switch handle 310 is rotated to be perpendicular to the connecting rod 320, that is, the switch handle 310 is tightened, at this moment, the switch handle 310 locks the connecting rod 320, the springs 330 are stressed to be in a compressed state, pins 343 on the pin members 340 of the two pin lock sets are engaged with pin holes 354 in the pin hole members 350 to realize a locked fixing state between the vertical pipes 210 and the running platform 100; when the switch handle 310 is rotated to be parallel to the connecting rod 320, that is, the switch handle 310 is loosened, at this moment, the switch handle 310 releases the connecting rod 320, the springs 330 are not stressed to release the compressed elastic force so that the pins 343 on the pin members 340 of the two pin lock sets are disengaged from the pin holes 354 in the pin hole members 350 to realize an unlocked free state between the vertical pipes 210 and the running platform 100.

Taking the pin members 340 arranged on the vertical pipes 210 and the pin hole members 350 arranged on the running platform 100 as an example, the folding and locking structure of the treadmill will be described in detail, as shown in FIGS. 3-6 and 8-10. However, it is worth noting that the pin members 340 may also be arranged on the running platform 100, and the pin hole members 350 may also be arranged on the vertical pipes 210. The specific positions of the above-mentioned pin members 340 and the pin hole members 350 can be selected and set according to actual situations.

Each pin member 340 includes a pin plate 341 and one pin set 342; the pin plate 341 is arranged on the vertical pipe 210, and the pin plate 341 is provided with a through hole for allowing the connecting rod 320 to pass through; the one pin set 342 is arranged on one side of the pin plate 341, and the pin set 342 includes at least one pin 343; the at least one pin 343 may be one pin 343, two pins 343, three pins 343 or more. In the present embodiment, three pins 343 are preferably adopted to form a triangular structure to ensure the firmness of the locking. Correspondingly, each pin hole member 350 includes a pin hole plate 351 and two pin hole 354 sets formed in the pin hole plate 351, and each pin hole 354 set includes at least one pin hole 354; the pin hole plate 351 is connected to and arranged on the running platform 100 via a connector 120, and the pin hole plate 351 is also provided with a through hole for allowing the connecting rod 320 to pass through; the two pin hole 354 sets include an unfolding pin hole set 352 for unfolding and a folding pin hole set 353 for folding, and the at least one pin hole 354 of each of the pin hole 354 sets is arranged corresponding to the at least one pin 343, so that the pin 343 is engaged with or disengaged from the pin hole 354. It is understandable that when the column assembly 200 is unfolded relative to the running platform 100, the unfolding pin hole set 352 corresponds to the pin set 342; when the column assembly 200 is folded relative to the running platform 100, the folding pin hole set 353 corresponds to the pin set 342, that is, one pin set 342 fits two pin hole 354 sets in different states; the at least one pin hole 354 may be one pin hole 354, two pin holes 354, three pin holes 354 or more. In the present embodiment, three pin holes 354 are preferably adopted to form a triangular structure, and cooperate with the three pins 343 to ensure the firmness of the locking.

The springs 330 may be arranged between the pin members 340 and the pin hole members 350. When the switch handle 310 is loosened, the springs 330 are not stressed to be restored to bounce off the pin members 340 and the pin hole members 350, that is, the pins 343 are disengaged from the pin holes 354. It is also possible that one end parts of the springs 330 abut against the pin members 340 and the other end parts of the springs 330 pass through the pin hole members 350 and abut against the interiors of ferrules 110. The ferrules 110 may be fixed on the connecting rod or on the running platform 100. In the present embodiment, the ferrules 110 are preferably arranged on the running platform 100 as long as the connecting rod can pass through the ferrules. When the switch handle 310 is tightened, the springs 330 are stressed to be compressed and the pins 343 are engaged with the pin holes 354. When the switch handle 310 is loosened, the springs 330 are stressed to be restored to push the pin members 340 away from the pin hole members 350 by elastic force, that is, the pins 343 are disengaged from the pin holes 354. Similarly, it is also possible that one end parts of the springs 330 abut against the pin hole members 350 and the other end parts of the springs 330 pass through the pin members 340 and abut against the interiors of ferrules 110. In order to improve the firmness of the locking between the pins 343 and the pin holes 354, and to further simplify the structure of the pin lock assembly and miniaturize the treadmill, the present embodiment preferably adopts an implementation in which one ends of the springs 330 abut against the pin members 340, and the other ends of the springs 330 pass through the pin hole members 350 and abut against the interiors of ferrules 110, which is not limited thereto.

In order to improve the convenience and quickness of folding and unfolding the column assembly 200, the pin lock assembly 300 further includes limiting members 370, wherein each limiting member 370 includes a limiting pin 371 and a limiting slot 372 which are matched, and the limiting slot 372 is set as an arc-shaped structure to adapt to a rotation path of the column assembly 200. Two ends of the limiting slot 372 exactly correspond to the unfolded state and the folded state of the column assembly 200. In specific implementation, the unfolded state and the folded state of the column assembly 200 can be easily switched without alignment. Furthermore, when the limiting pin 371 is respectively located at the two ends of the limiting slot 372, the pin set 342 also exactly corresponds to the unfolding pin hole set 352 or the folding pin hole set 353, avoiding unfirm locking caused by misalignment in the process of unfolding and folding or potential safety hazards from deviation wear.

It should be noted that the limiting pins 371 are optionally arranged on the pin plates 341 and on the same side as the pin sets 342. Correspondingly, the limiting slots 372 are arranged on the pin hole plates 351. Alternatively, the limiting pins 371 are arranged on the pin hole plates 351, and the limiting slots 372 are arranged on the pin plates 341.

Further, the pin lock assembly 300 further includes a thrust member 380 sleeving the connecting rod 320 and located between the switch handle 310 and the pin member 340. When the switch handle 310 is tightened, the pin member 340 can be further pressed by the thrust member 380 to ensure that the pins 343 are firmly engaged with the pin holes 354, and the stability of the locking is improved. Further, the thrust member 380 may also be arranged at the end, away from the switch handle 310, of the connecting rod 320 to further improve the connecting and locking firmness of the vertical pipes 210 on two sides of the running platform 100.

Further, a push block 311 is further arranged at the end, connected to the connecting rod 320, of the switch handle 310. When the switch handle 310 is tightened, that is, when the switch handle 310 is perpendicular to the connecting rod, the push block 311 abuts against the pin member 340 or the thrust member 380 so as to provide a thrust force directly or through the thrust member 380 to engage the pins 343 on the pin member 340 with the pin holes 354. The other end of the connecting rod receives a pulling force toward the switch handle 310, and the locking member 360 at this end abuts against the adjacent pin member 340 and engages the pins 343 on the pin member 340 with the pin holes 354.

Further, the column assembly 200 further includes vertical pipe housings 230 sleeving the vertical pipes 210. One end of each vertical pipe 210 is connected to the vertical pipe housing 230, and the other end is not connected to the vertical pipe housing 230, so that the vertical pipes 210 can approach or be far away from the running platform 100.

The principle of the above folding treadmill is as follows:

1. When the treadmill is to be folded, the switch handle 310 is loosened, the springs 330 are restored to push the pins 343 away from the pin holes 354 of the unfolding pin hole set 352 to be disengaged from the pin holes 354, the column assembly 200 and the running platform 100 are in an unlocked free state, the column assembly 200 is laid flat toward the tail of the running platform 100, the limiting pins 371 just move to the other ends of the limiting slots 372. At this time, the column assembly 200 is in the folded state, and then the switch handle 310 is tightened to engage the pins 343 with the pin holes 354 of the folding pin hole set 353. The column assembly 200 and the running platform 100 are in a locked fixing state to complete the folding.

2. When the treadmill is to be unfolded, the switch handle 310 is loosened, the springs 330 are restored to push the pins 343 away from the pin holes 354 of the folding pin hole set 353 to be disengaged from the pin holes 354, the column assembly 200 and the running platform 100 are in an unlocked free state, the column assembly 200 is unfolded toward the head of the running platform 100, the limiting pins 371 just move to the other ends of the limiting slots 372. At this time, the column assembly 200 is in the unfolded state, and then the switch handle 310 is tightened to engage the pins 343 with the pin holes 354 of the unfolding pin hole set 352. The column assembly 200 and the running platform 100 are in a locked fixing state to complete the unfolding.

According to the folding method of a treadmill in the present disclosure, by means of the pin lock assembly 300, the column assembly 200 can be firmly locked on the running platform 100 no matter whether the column assembly 200 is in an unfolded state or a folded state, thus not only achieving rapid unfolding and folding, but also ensuring the stability of the unfolded state or the folded state, and improving the safety of the folded state. The folding treadmill in the present disclosure is in a folded state during transportation, which is beneficial to minimizing the packing size; and when the folding treadmill needs to be unfolded or folded, a user can easily and conveniently complete unfolding or folding by operating the pin lock assembly 300.

The pin lock assembly 300 in the present disclosure achieves the purpose of unlocking and locking through the principle of eccentricity. Each unfolding or folding is completed with only three steps of loosening the switch handle 310→folding the column assembly 200 or unfolding the column assembly 200→tightening the switch handle 310. Not only is the unfolding or folding process convenient and quick, but also the pin lock set is formed by the combination of the pin member 340, the pin hole member 350 and the spring 330 to provide a firmer and stabler locking structure, thus avoiding the loosening problem caused by high and mild vibration of the running platform 100 when working, and solving the problem of the complex folding structure of an existing treadmill, the problem of failing to miniaturize the treadmill caused by the large size of the folding structure, and the problem of the cumbersome folding operation. The switch handle 310 in the present disclosure is located on the side of the treadmill, which is relatively hidden and does not have the problem of misstepping or misrotation, and improves the safety performance of the folding treadmill.

As described above, the present disclosure has been described in detail through the preferred embodiments, but those of ordinary skill in the art should understand that the present disclosure is not limited thereto, and various modifications and applications can be made without departing from the spirit of the present disclosure. Therefore, the true scope of protection of the present disclosure should be interpreted by the appended claims, and all technical spirits within the equivalent scope should be interpreted as being included in the scope of the present disclosure.

What is claimed is:

1. A folding method of a folding treadmill, comprising following steps: unlocking a pin lock assembly to enable a column assembly and a running platform to be in an unlocked free state, then unfolding or folding the column assembly to be in an unfolded state or a folded state relative to the running platform, and locking the pin lock assembly to complete the unfolding or folding of the treadmill, wherein the pin lock assembly comprises a switch handle, a connecting rod, at least two springs, at least two pin members and at least two pin hole members; the switch handle is eccentrically rotatably connected to one end of the connecting rod and is arranged on one side of the running platform; the springs, the pin members and the pin hole members sleeve the connecting rod; a locking member is arranged on the other end of the connecting rod and is arranged on the other side of the running platform; one of the pin members, one of the springs and one of the pin hole members are arranged opposite to each other to form a pin lock set, and two pin lock sets are respectively arranged between two vertical pipes of the column assembly and the running platform; and end parts of the springs abut against the pin members and/or the pin hole members, wherein the pin members are arranged on the running platform, and the pin hole members are correspondingly arranged on the vertical pipes.

2. The folding method of the folding treadmill according to claim 1, wherein a push block is arranged at an end of the switch handle, and the end is connected to the connecting rod.

3. The folding method of the folding treadmill according to claim 2, wherein each of the pin members comprises a pin plate and one pin set, the one pin set is arranged on one side of the pin plate, and the one pin set comprises at least one pin; each of the pin hole members comprises a pin hole plate and two pin hole sets formed in the pin hole plate, each of the pin hole sets comprises at least one pin hole; the two pin hole sets comprise an unfolding pin hole set for unfolding and a folding pin hole set for folding, and the at least one pin hole of each of the pin hole sets is arranged corresponding to the at least one pin.

4. The folding method of the folding treadmill according to claim 3, wherein the at least one pin comprises at least three pins, and the at least one pin hole comprises at least three pin holes.

5. The folding method of the folding treadmill according to claim 1, wherein each of the pin members comprises a pin plate and one pin set, the one pin set is arranged on one side of the pin plate, and the one pin set comprises at least one pin; each of the pin hole members comprises a pin hole plate and two pin hole sets formed in the pin hole plate, each of the pin hole sets comprises at least one pin hole; the two pin hole sets comprise an unfolding pin hole set for unfolding and a folding pin hole set for folding, and the at least one pin hole of each of the pin hole sets is arranged corresponding to the at least one pin.

6. The folding method of the folding treadmill according to claim 5, wherein the at least one pin comprises at least three pins, and the at least one pin hole comprises at least three pin holes.

7. The folding method of the folding treadmill according to claim 1, wherein the pin lock assembly further comprises a limiting member, wherein the limiting member comprises a limiting pin and a limiting slot which are matched, and the limiting slot is set as an arc-shaped structure to adapt to a rotation path of the column assembly.

8. The folding method of the folding treadmill according to claim 1, wherein the pin lock assembly further comprises a thrust member, and the thrust member sleeves the connecting rod and is located between the switch handle and one of the pin members.

9. A folding treadmill, comprising:

a pin lock assembly, a column assembly, and a running platform;

wherein the treadmill is configured such that unlocking the pin lock assembly enables the column assembly and the running platform to be in an unlocked free state, then unfolding or folding the column assembly to be in an unfolded state or a folded state relative to the running platform, and locking the pin lock assembly to complete the unfolding or folding of the treadmill, wherein the pin lock assembly comprises a switch handle, a connecting rod, at least two springs, at least two pin members and at least two pin hole members; the switch handle is eccentrically rotatably connected to one end of the connecting rod and is arranged on one side of the running platform; the springs, the pin members and the pin hole members sleeve the connecting rod; a locking member is arranged on the other end of the connecting rod and is arranged on the other side of the running platform; one of the pin members, one of the springs and one of the pin hole members are arranged opposite to each other to form a pin lock set, and two pin lock sets are respectively arranged between two vertical pipes of the column assembly and the running platform; and end parts of the springs abut against the pin members and/or the pin hole members, wherein the pin members are arranged on the running platform, and the pin hole members are correspondingly arranged on the vertical pipes.

10. A folding method of a folding treadmill, comprising following steps: unlocking a pin lock assembly to enable a column assembly and a running platform to be in an unlocked free state, then unfolding or folding the column assembly to be in an unfolded state or a folded state relative to the running platform, and locking the pin lock assembly to complete the unfolding or folding of the treadmill, wherein the pin lock assembly comprises a switch handle, a connecting rod, at least two springs, at least two pin members and at least two pin hole members; the switch handle is eccentrically rotatably connected to one end of the connecting rod and is arranged on one side of the running platform; the springs, the pin members and the pin hole members sleeve the connecting rod; a locking member is arranged on the other end of the connecting rod and is arranged on the other side of the running platform; one of the pin members, one of the springs and one of the pin hole members are arranged opposite to each other to form a pin lock set, and two pin lock sets are respectively arranged between two vertical pipes of the column assembly and the running platform; and end parts of the springs abut against the pin members and/or the pin hole members, wherein the pin members are arranged on the vertical pipes, and the pin hole members are correspondingly arranged on the running platform, wherein each of the pin members comprises a pin plate and one pin set, the one pin set is arranged on one side of the pin plate, and the one pin set comprises at least one pin; each of the pin hole members comprises a pin hole plate and two pin hole sets formed in the pin hole plate, each of the pin hole sets comprises at least one pin hole; the two pin hole sets comprise an unfolding pin hole set for unfolding and a folding pin hole set for folding, and the at least one pin hole of each of the pin hole sets is arranged corresponding to the at least one pin.

11. The folding method of the folding treadmill according to claim 10, wherein the at least one pin comprises at least three pins, and the at least one pin hole comprises at least three pin holes.

* * * * *